US008136467B2

(12) United States Patent
Powell et al.

(10) Patent No.: US 8,136,467 B2
(45) Date of Patent: Mar. 20, 2012

(54) INFLATABLE FENDER FOR A BOAT

(76) Inventors: Steven Martin Powell, Valencia (ES); Tina Louise Powell, Valencia (ES)

( * ) Notice: Subject to any disclaimer, the term of this patent is extended or adjusted under 35 U.S.C. 154(b) by 316 days.

(21) Appl. No.: 12/519,175

(22) PCT Filed: Dec. 14, 2007

(86) PCT No.: PCT/GB2007/050759

§ 371 (c)(1),
(2), (4) Date: Jun. 15, 2009

(87) PCT Pub. No.: WO2008/072019

PCT Pub. Date: Jun. 19, 2008

(65) Prior Publication Data

US 2010/0031862 A1 Feb. 11, 2010

(30) Foreign Application Priority Data

Dec. 15, 2006 (GB) ..... 0625066.6

(51) Int. Cl.
*B63B 59/02* (2006.01)

(52) U.S. Cl. ..... 114/219

(58) Field of Classification Search ..... 114/68, 114/219, 69, 123, 220, 360, 361; 405/212–215
See application file for complete search history.

(56) References Cited

U.S. PATENT DOCUMENTS

| | | | | | |
|---|---|---|---|---|---|
| 1,375,055 | A | * | 4/1921 | Lodato | 114/68 |
| 1,375,151 | A | * | 4/1921 | Hamilton | 114/68 |
| 2,453,149 | A | * | 11/1948 | McCutchen | 114/9 |
| 3,822,662 | A | * | 7/1974 | Morita et al. | 114/123 |
| 5,113,779 | A | * | 5/1992 | Amrein et al. | 440/12.63 |
| 5,215,031 | A | | 6/1993 | Inman et al. | |
| 7,509,920 | B2 | * | 3/2009 | Taylor | 114/360 |

FOREIGN PATENT DOCUMENTS

| | | | |
|---|---|---|---|
| DE | 3810546 | A1 * | 10/1988 |
| DE | 29704772 | | 3/1997 |
| EP | 0568501 | | 3/1993 |
| EP | 0987176 | | 3/2000 |
| FR | 2497760 | A * | 7/1982 |
| GB | 2381845 | | 11/2001 |
| JP | 11301586 | | 11/1999 |

* cited by examiner

*Primary Examiner* — Ajay Vasudeva

(57) ABSTRACT

An inflatable fender for a boat comprises an enclosure (2) mounted on the boat hull (5) and connectible to a fluid supply, an inflatable flexible member (4) mounted within the enclosure and capable of extending therefrom when inflated by fluid supplied to the enclosure, and separate retraction means (8) associated with the enclosure and operable to withdraw the inflatable member into the enclosure when deflated.

6 Claims, 10 Drawing Sheets

Fig 8
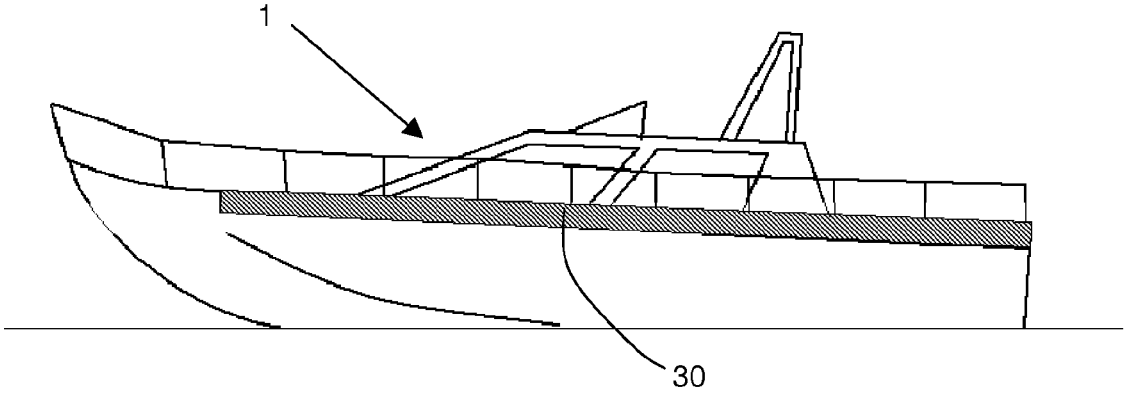
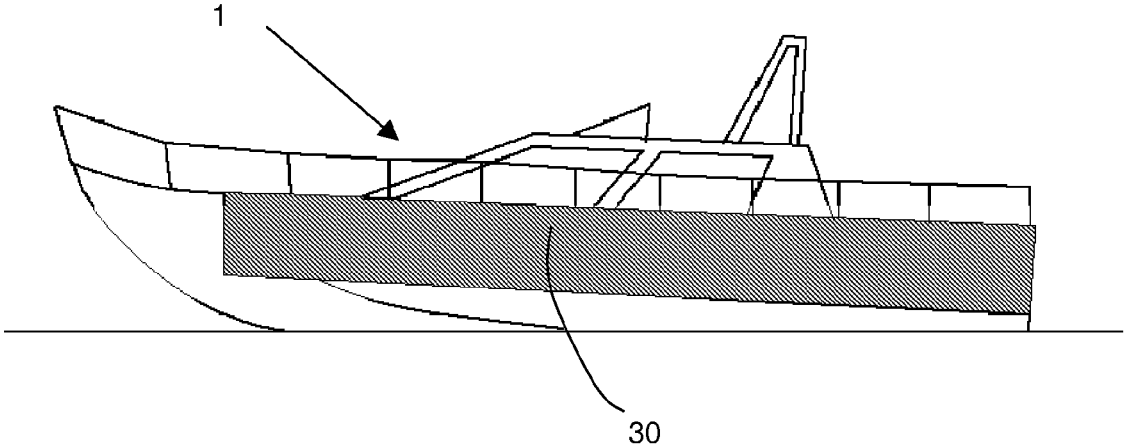
Fig 9

INFLATABLE FENDER FOR A BOAT

FIELD OF THE INVENTION

This invention relates to an inflatable fender for a boat.

BACKGROUND OF THE INVENTION

Smaller sailing and motor boats typically deploy fenders when mooring at jetties or against other boats to protect the boat or boats from impact and abrasion damage. The fenders are usually formed of resilient plastics materials and may be hollow to allow for some deformation when absorbing the energy of an impact, for example. The fenders are commonly deployed, only when needed, by tying each one in place and placing them to hang at the side of the boat. On smaller boats in particular this operation can be difficult, particularly in choppy sea conditions, running the risk of the person failing overboard. There is therefore a need for a system which enables fenders to be automatically deployed when needed and automatically retracted when not needed.

JP11301586 discloses an air bag device for absorbing impact shock. A number of the devices are located around the hull of the boat and are inflated by compressed air when bringing the boat alongside a pier, quay or another boat. The air bags are held within containers attached to the side of the boat, and when deflated are intended to retract into the containers, which are provided with hinged covers. A problem with this arrangement is that it depends on the air bags being elastic so as to return to the original small size when deflated. This would require the bags to be formed of relatively thin material to allow the desired degree of stretching during inflation, and high pressure compressed air would be required to inflate them. As a result, there would be a considerable risk of explosive deflation if the bag is over-inflated, punctured or suffers excessive compressive force during impact. This could result in risk to the occupants of the boat of injury from high velocity fragments of the air bag, and would render the boat itself unprotected by fenders and therefore at risk of impact or abrasive damage.

In order to achieve sufficient protection without the need for a high degree of inflation, the fenders would need to be made larger in the uninflated configuration, and this would lead to an unacceptable effect on the clean lines of the boat, or would take up space within the boat hull.

GB2381845A and DE29704772U1 both disclose an inflatable fender for a boat, comprising an enclosure mounted on or in the boat hull and connectible to a fluid supply, an inflatable flexible member in the form of a flat tube rolled around a first roller mounted within the enclosure and the fluid supply being connectable to the tube to inflate the tube, the tube extending from the enclosure when inflated, and drive means being provided to rotate the roller to retract the tube when not required, the fluid supply being arranged to allow the fluid to withdraw from the tube as the tube is rolled on to the roller.

SUMMARY OF THE INVENTION

The present invention is characterized in that a secondary roller is provided adjacent to the first roller to press on to the tube rolled therearound, such that, on inflation, the tube extends from between the first and the secondary roller and causes the tube to unroll from the roller.

In another embodiment, the inflatable member comprises a resiliently extendible member connected between the free end of the inflatable member and the enclosure and arranged to extend when the inflatable member is inflated and to retract to withdraw the inflatable member into the enclosure when said member is deflated. The resiliently extendible member may comprise a spring or elastic cord within the inflatable member, but in one embodiment, the enclosure is formed from a resiliently deformable material having a portion which at rest forms a coil surrounding and containing the inflatable member, and which, when the member is inflated, is caused to uncoil to allow the inflatable member to extend. Deflation of the inflatable member allows the coil to resume its rest position.

In yet another embodiment, where the fluid is a gas, the retraction means comprises a vacuum pump connected to the interior of the enclosure and operable to withdraw gas from the inflatable member when the fender is no longer required, thereby retracting it into the enclosure.

The fluid may be air, supplied by a compressor, for example through an intermediate storage tank so that a high pressure supply is readily available when needed. Alternatively, other pressurised gases could be used, such as carbon dioxide or nitrogen, although these have the disadvantages of requiring heavy storage tanks and not be readily replenishable. Gases offer the additional advantage of providing additional buoyancy to the boat in an emergency. Another possibility would be water, which offers the advantages of ready availability and not requiring high pressure, although its relative inelasticity means that some air space within the inflatable members would still be required. Other disadvantages of using water are the weight added to the boat, the relatively slowness of inflation of the members, and the increased likelihood of corrosion of components coming into contact with the water, especially if sea-water is used.

The inflatable fenders may be manufactured from elastomers, for example a butyl rubber, or from a woven polymer material provided with an fluid-tight liner.

In one embodiment, the inflatable flexible member is in the form of a flat tube rolled around a first roller, and a secondary roller is provided adjacent to the first roller, a fluid supply being connectable to the tube to inflate the tube extending from between the first roller and the secondary roller, thereby causing the tube to unroll from the roller, drive means being provided to rotate the roller to retract the tube when not required, the fluid supply being arranged to allow the fluid to withdraw from the tube as the tube is rolled on to the roller.

A rotary connection may be provided to supply inflating fluid from a supply to the interior of the tube. The rotary connection may comprise a hose coiled around the axis of the first roller and connected at its inner end to the innermost end of the tube, the coil then tightening as the fender deploys and loosening as the fender is retracted. Alternatively, the rotary connection may comprise a rotating sealed joint on the axis of rotation of the first roller, communicating through the roller with the interior of the tube.

The invention provides an inflatable fender system in which the fender can be rapidly deployed by the operation of a single control, such as a solenoid-operated valve, and can be equally easily retracted neatly into its enclosure when not required, without the need for the fender to resiliently inflate, thereby permitting its operation at a safe internal pressure.

BRIEF DESCRIPTION OF THE DRAWINGS

In the drawings, which illustrate exemplary embodiments of the invention:

FIG. 8 is a side elevation of a boat having a fender system in accordance with yet another embodiment of the invention, in which the fenders form a continuous curtain along the side of the boat, the curtain being retracted;

FIG. 9 is a view corresponding to that of FIG. 8, but with the fender curtain extended;

DETAILED DESCRIPTION OF THE ILLUSTRATED EMBODIMENT

Figure 1:
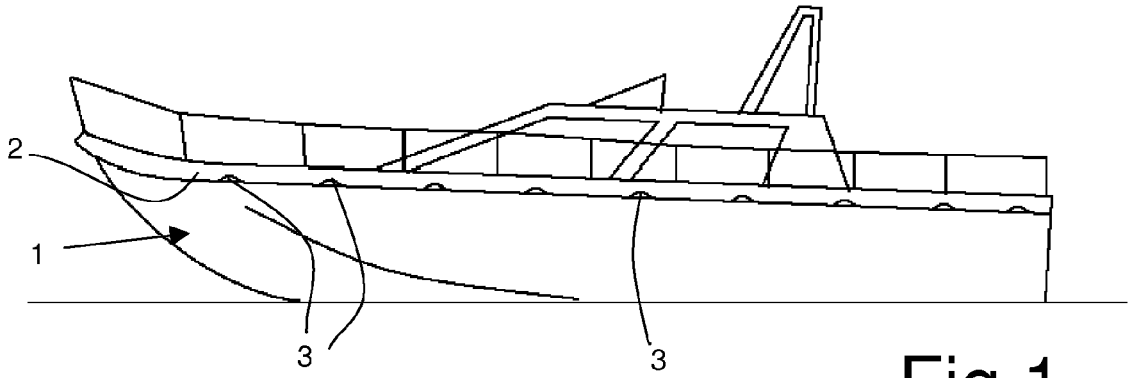
FIG. 1 is a side elevation of a boat having a fender system in accordance with the invention, the fenders being retracted.
Figure 2:
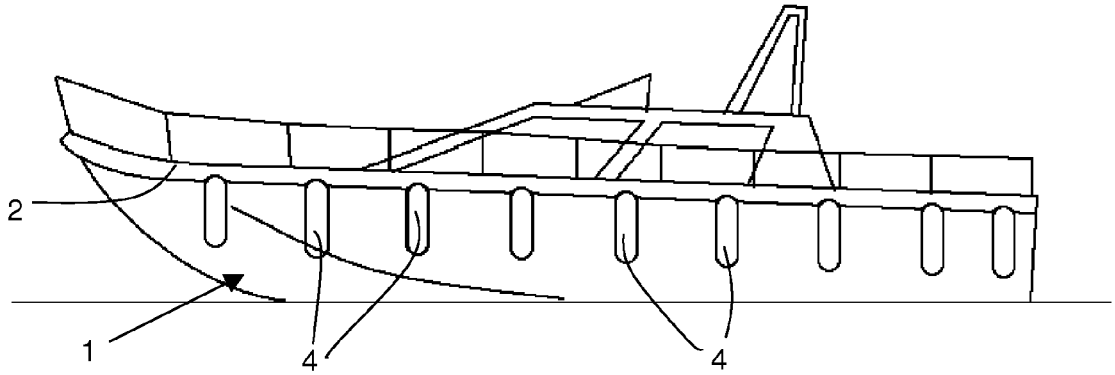
FIG. 2 is a view corresponding to that of FIG. 1, but with the fenders extended.

Referring to FIGS. 1 and 2, a boat 1 is provided with an inflatable fender system consisting of a housing 2 mounted along the gunwale and having a plurality of openings 3 spaced therealong from which inflatable fenders 4 can be extended down the side of the boat's hull. When the boat leaves the jetty or pier against which it was moored, the fenders are deflated and retracted.

Figure 3:
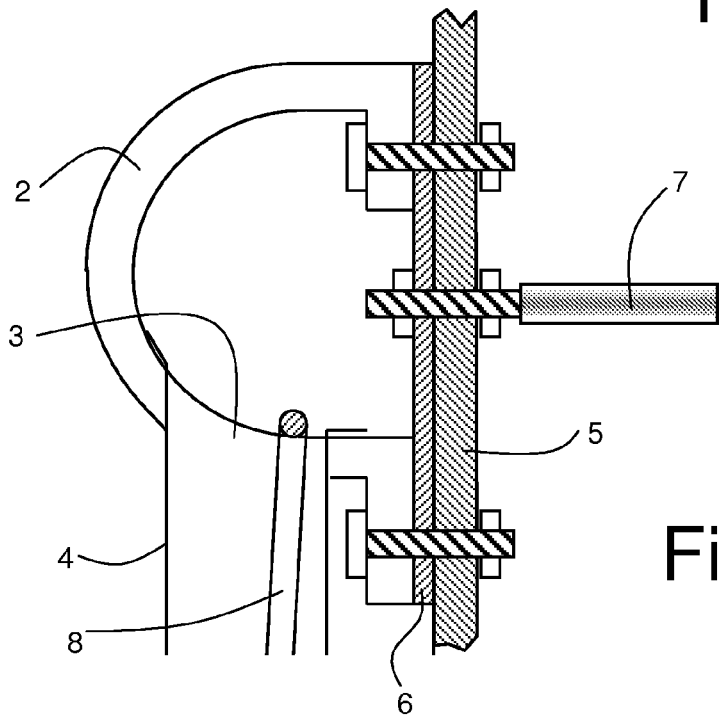
FIG. 3 is an enlarged cross-sectional view of the top part of a fender according to one embodiment of the invention.

FIG. 3 illustrates one embodiment of the inflatable fender system of the invention. The housing 2 consists of a hollow moulding which is bolted on to the hull 5 of the boat with a sealing membrane 6 interposed to ensure an air-tight seal. A compressed air pipe 7 passes through the hull 5 to open into the housing 2. The pipe 7 is connected via a control valve to a compressed air tank supplied by a compressor (not shown). The inflatable members 4 constituting the fenders are sealed to the inner surface of the housing 2 and extend through the openings 3 when inflated by air pressure within the housing. Each of the members 4 contains a retraction cord 8, which is attached to the free end of the member 4 and extends back inside the housing to a common elastic cord or bungee (not shown), which can pull all the cords on the respective side of the boat simultaneously to retract the members 4 into the housing (in practice, a short length of each of the fender members 4 may be left protruding from the housing to ensure correct deployment when the housing is pressurised). Alternatively, the retraction cord 8 may itself be a discrete length of elastic cord which, when the fender is deflated, contracts to pull the inflatable member 4 back into the housing.

Figure 4:
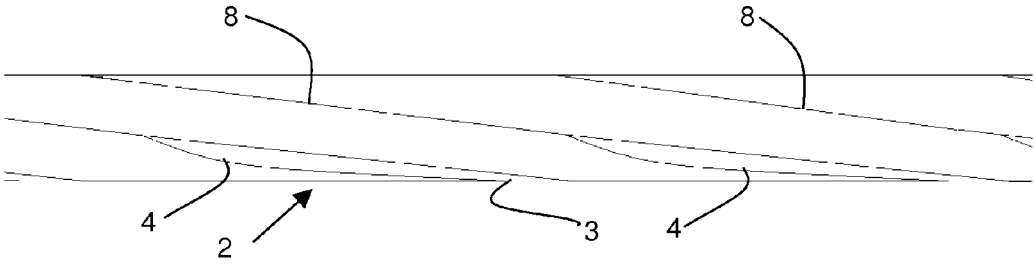
FIG. 4 is a side elevation of a portion of the system shown in FIG. 3, with the fenders retracted.
Figure 5:
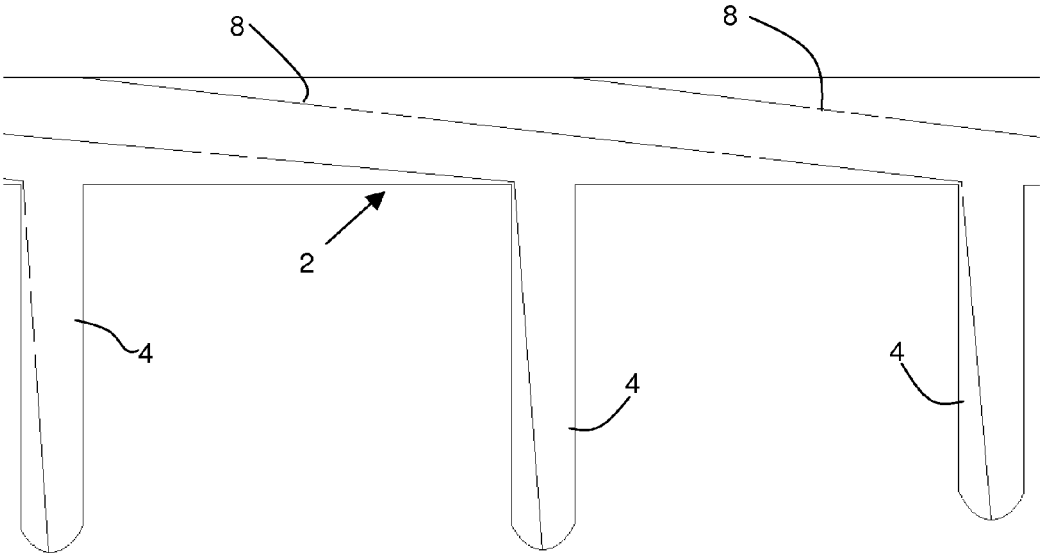
FIG. 5 is a view corresponding to FIG. 4 with the fenders extended.

FIG. 4 is a longitudinal section through the housing 2, showing the retracted fender members 4 pulled into the housing by the cords 8. FIG. 5 is a corresponding view with the fenders 4 pressurised and extended.

Figure 6:
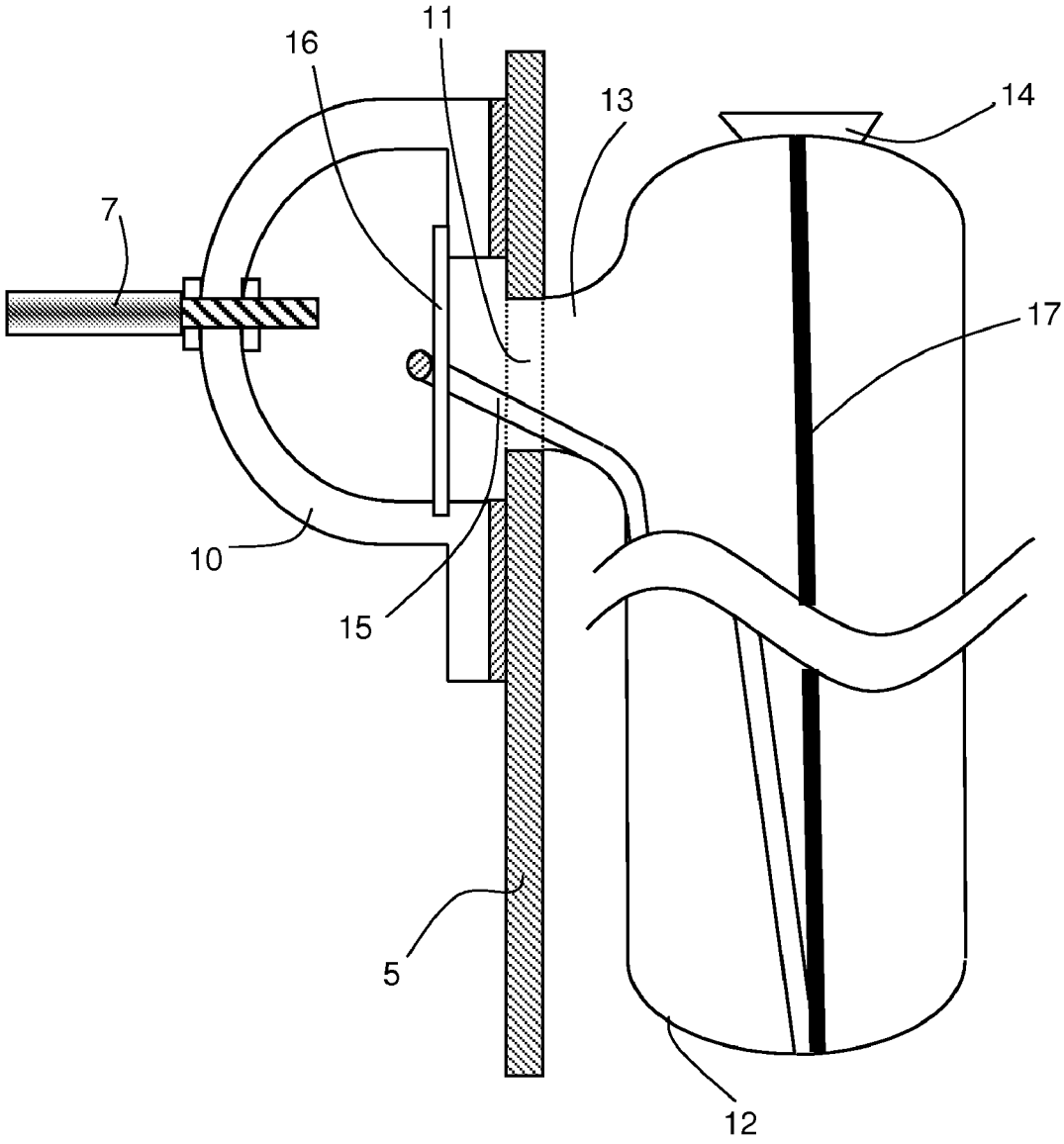
FIG. 6 is an enlarged cross-sectional view of another embodiment of the invention.

FIG. 6 shows another arrangement, in which the enclosure or housing 10 is mounted on the inside wall of the hull 5, the compressed air supply pipe 7 extending through the wall of the housing 10. Apertures 11 are then provided at intervals along the hull. Each fender 12 consists of an elongate bottle structure having a side opening 13 which is sealed into the respective aperture 11. At the upper end of the fender 12 a plug 14 is attached; this fits into the aperture 11 when the fender is retracted. A cord 15 extends inside the fender 12 from the lowermost point thereof through the opening to pass around a bar 16 whose function is to allow the cord to pull straight and so the plug 14 will sit straight in the aperture 11. The cord 15 is linked to a common elastic cord (not shown) which serves to pull all the cords in when the pressure is released. A cord 17, for example a length of nylon rope, is provided internally between the opposed ends of the fender to hold the plug tightly in place when the fender is retracted.

Figure 7:
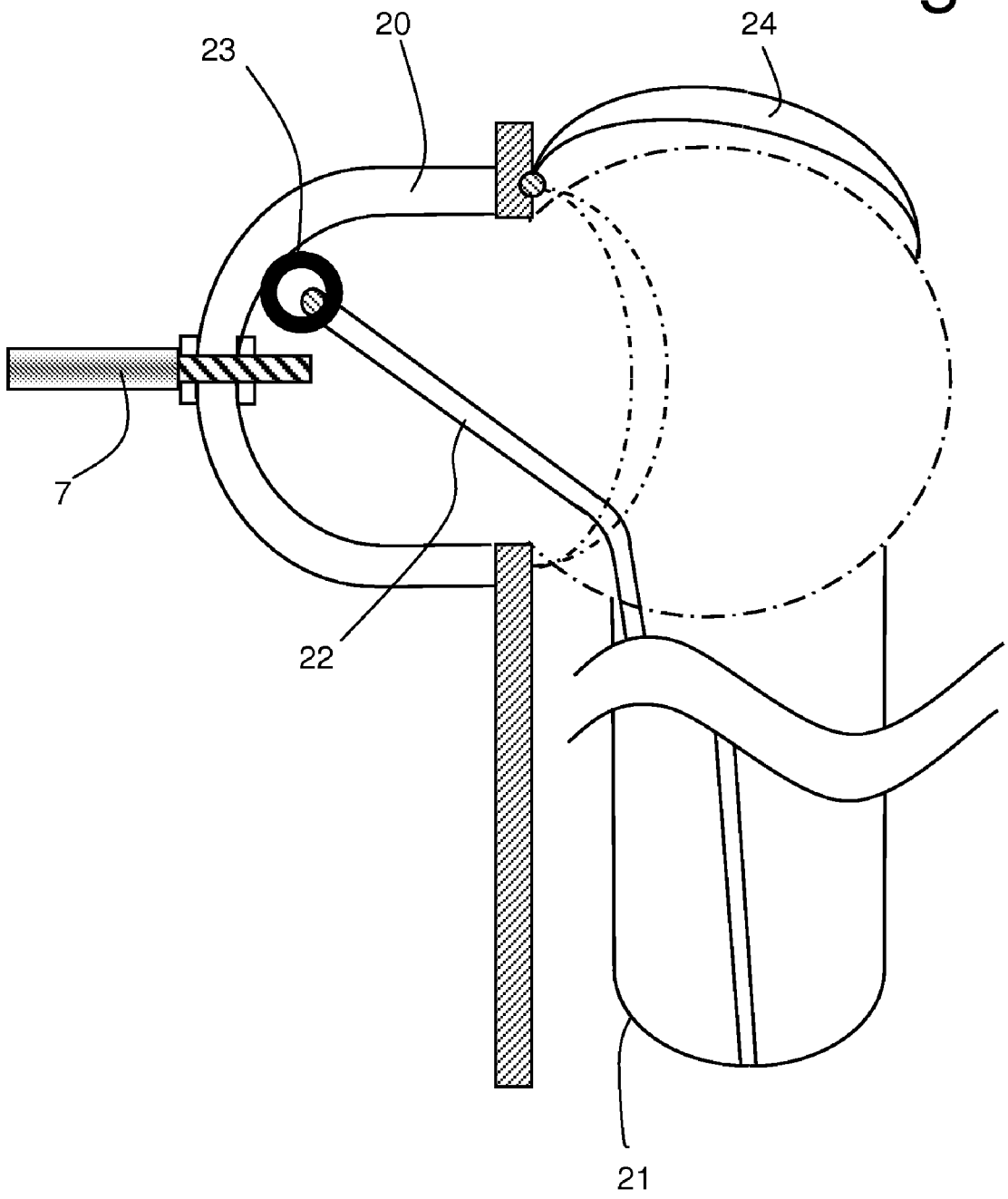
FIG. 7 is an enlarged cross-sectional view of a third embodiment of the invention.

The embodiment of FIG. 7 provides a channel member 20 as the enclosure for the fenders 21 which extend through openings in the side of the hull 5 when the channel is pressurised by the compressed air supply pipe 7. A number of discrete openings housing individual fenders may be provided, or, as an alternative, a continuous channel may house a curtain type of fender. A cord 22 extends from the lowermost point inside the fender through a guide ring 23 to a common elastic cord or bungee (not shown) to pull all the cords simultaneously to retract the deflated fenders. Hinged covers 24 are spring-biased to close over the openings to present a clean appearance.

Figure 10:
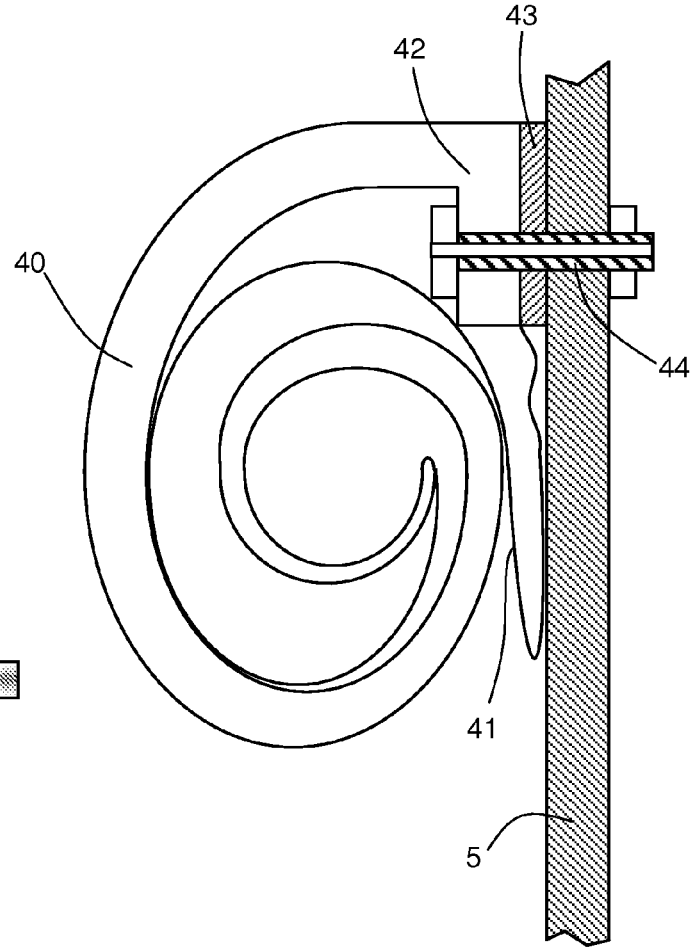
FIG. 10 is an enlarged cross-sectional view of the fender shown in FIG. 8, in the retracted position.
Figure 11:
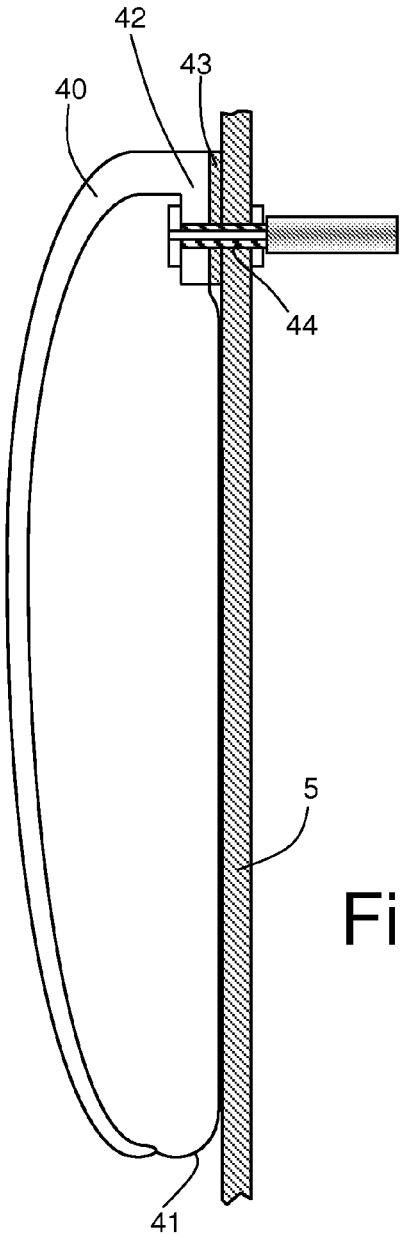
FIG. 11 is a corresponding view, on a slightly smaller scale, of the fender in the extended position illustrated in FIG. 9.

FIGS. 8 and 9 illustrate a boat 1 provided with an inflatable fender system consisting of an inflatable curtain 30 which can be extended down the side of the boat's hull, to provide a continuous fender, as shown in FIG. 9. FIGS. 10 and 11 illustrate one embodiment of this curtain arrangement. In this embodiment, the housing and the curtain fender are combined together. The housing is formed of a tough resilient material 40 with a flexible membrane 41 welded to it around the edge thereof, the other side of the membrane being clamped between the mounting bracket 42 for the housing and a sealing strip 43 against the hull 5. At least one of the mounting bolts 44 for the housing 40 has a passageway therethrough for admission of compressed air to inflate the fender. The tough resilient material 40 forming the housing is moulded in a coiled form so that the material has a "memory" for this configuration, as illustrated in FIG. 10. When compressed air is introduced into the fender, the pressure caused the material 40 to unroll as the fender extends downwardly against the side of the boat, the fully extended position being illustrated in FIG. 11. Release of the pressure allows the material 40 to coil up again, to provide a neat appearance and to protect the membrane 41. If necessary, the deflation and coiling can be facilitated by connecting an extractor pump to the interior of the fender through one or more other fixing bolts.

Figure 12:
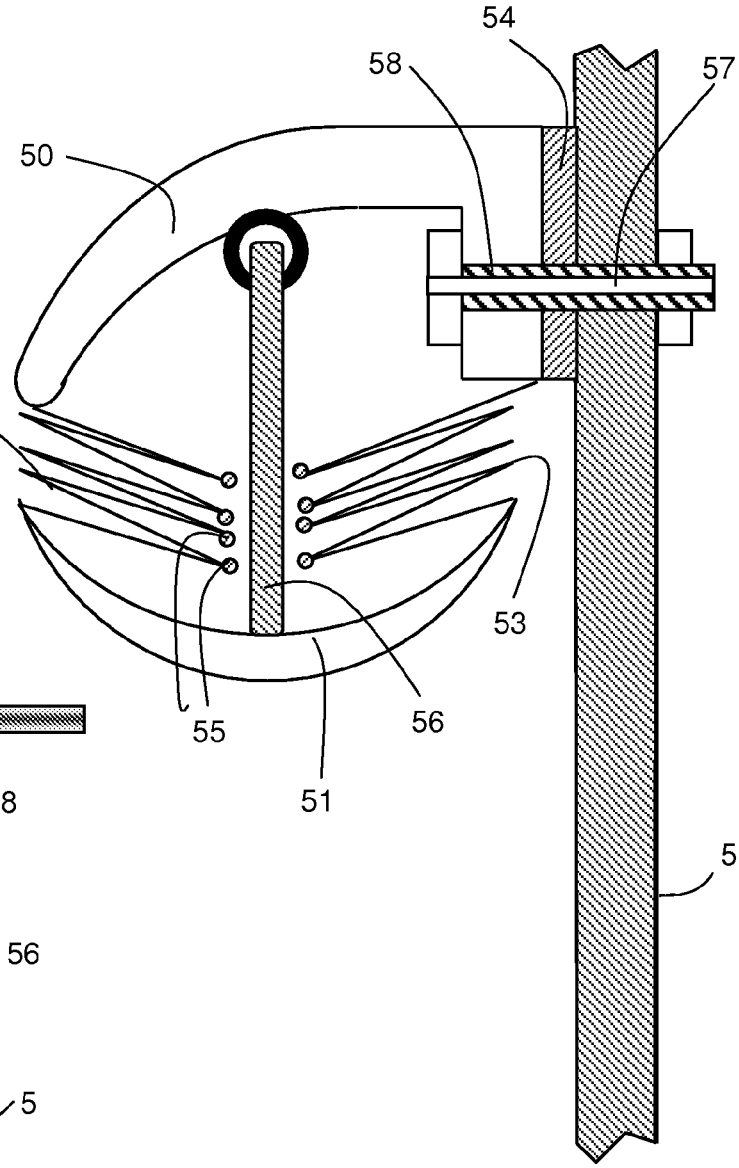
FIG. 12 is an enlarged cross-sectional view of a fender according to a still further embodiment of the invention, shown in the retracted condition.
Figure 13:
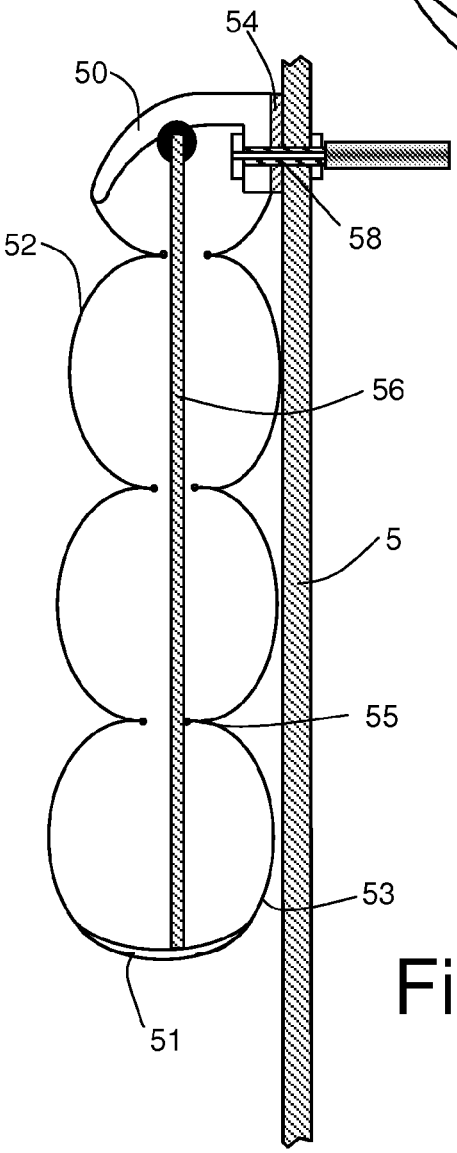
FIG. 13 is a corresponding view, on a slightly smaller scale, of the fender of FIG. 12 in the extended position thereof.

FIGS. 12 and 13 show another alternative curtain fender arrangement. In this embodiment, the housing comprises two separate parts, an upper bracket 50 bolted to the side of the hull, and a lower cap moulding 51. The fender is formed from an inner flexible membrane 52 sealed to the outer edge of the bracket 50 and to the outer edge of the cap moulding, and an inner flexible membrane 53 held along one edge between the bracket 50 and its seal 54 against the hull, and along the other edge on the inner edge of the cap moulding 51. Reinforcing ribs 55 divide the membranes 52 and 53 into segments providing additional resilience in the event of impacts with the fender. Elastic cords or bungees 56 are provided at intervals along the fender to assist in retracting the fender when deflated. The segmented arrangement allows the fender system to concertina to close within the housing. The application of a vacuum to the fender may assist this process. Compressed air is introduced through a passageway 57 through at least one of the mounting bolts 58. FIG. 12 shows the fender near to its closed position, while FIG. 13 shows the extended position.

While the attachment of the fender system by bolts has been described, it will be appreciated that alternative fixings can be used. For example, the use of adhesive would avoid the need to drill through the hull, except for where the compressed air supply is to enter the housing. Where adhesive is used, the need for the separate seals 43 and 54, for example, can be avoided. The fender system can be incorporated into the design of new boats, but can also be arranged to be retrofitted to existing boats.

Figure 14:
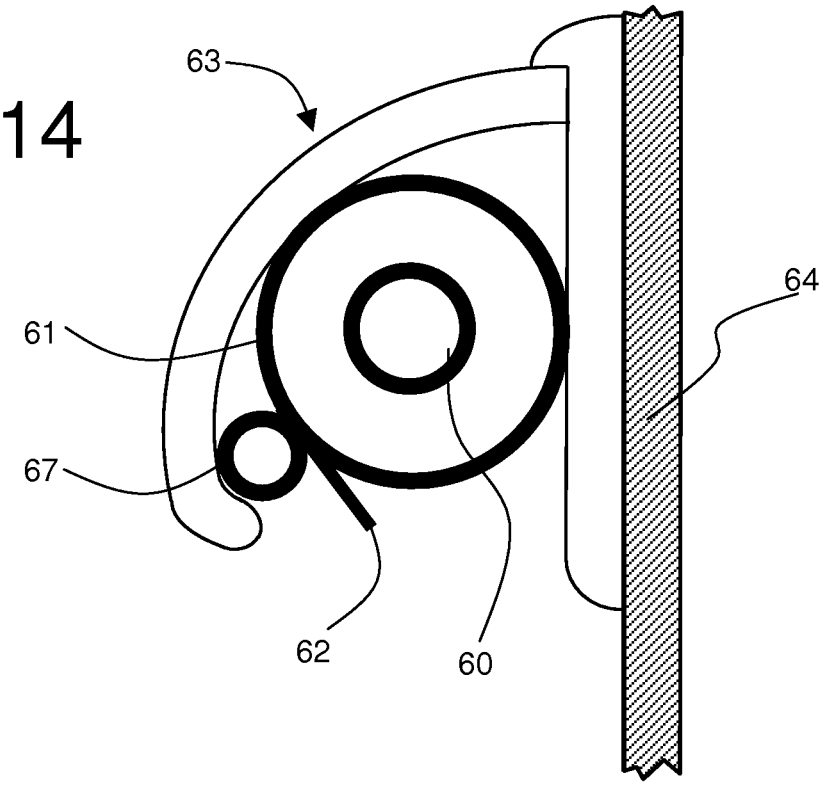
FIG. 14 is a side elevation of a portion of a boat hull having mounted thereon an inflatable fender according to another embodiment of the invention.
Figure 15:
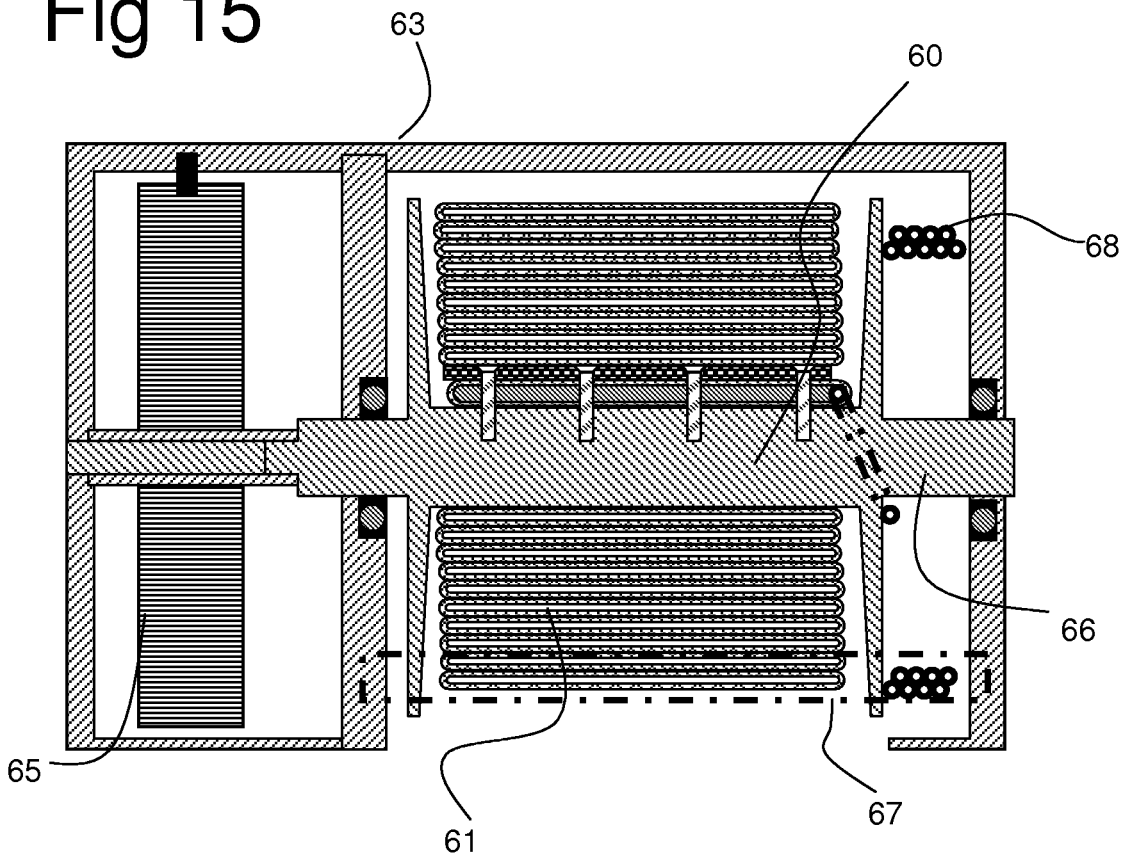
FIG. 15 is a front sectional view of a fender of the type shown diagrammatically in FIG. 14, with the cover removed for clarity.

Referring now to FIGS. 14 and 15, the fender comprises a roller 60 around which is wound a flat tubular flexible member 61 having a closed end 62 so as to be inflatable when compressed air is introduced into it. The roller 60 is rotatable mounted within an enclosure 63 mounted on the outer surface of the boat hull 64. The roller 60 has at one end thereof a spring retraction mechanism 65 which is tensioned as the flexible member 61 is unreeled from the roller 60, and which can therefore retract the flexible member when the inflating pressure in it is released. Such mechanisms are well-known and will therefore not be described in detail. The other end of the roller 60 carries a reel 66 for a pressure hose 68 which at one end is connected to a selective source of compressed air, for example from a central supply tank in turn charged by a compressor, and at the other end is connected to the flexible member 61 at the centre of the reel through a sealed inlet. The hose coil 68 tightens in the manner of a watch spring as the fender extends, and loosens as the fender retracts. A secondary roller 67 rests against the reel 66 to ensure that significant inflation of the fender occurs only off the reel. The flexible member is suitably in the form of a fabric-reinforced rubber whose stiffness and internal texture ensure that there will always be a passageway for air to flow from the hose inlet to the free end on inflation, and in the other direction on deflation and retraction.

In use, the fender is extended by applying compressed air through the hose 68 to the flexible member rolled on to the roller 60. The air passes through the coiled hose, causing the free end extending beyond the secondary roller 67 to inflate, progressively unrolling the member 61 from the roller, and at the same time tensioning the spring retraction mechanism. This continues until the fender is fully extended, the pressure being maintained to hold the fender in its operative position. When the fender is to be retracted, the pressure in the hose is released and the compressed air is allowed to vent to atmosphere. As the tubular member 61 deflates, the retraction mechanism 65 rotates the roller 60 to reel in the tubular member 61, the secondary roller 67 guiding the member to lie flat on the reel, thereby ensuring that the compressed air is fully expelled. The configuration illustrated in FIG. 14 offers the advantage of requiring no penetration of the hull, enabling easy installation on existing boats.

Figure 16:
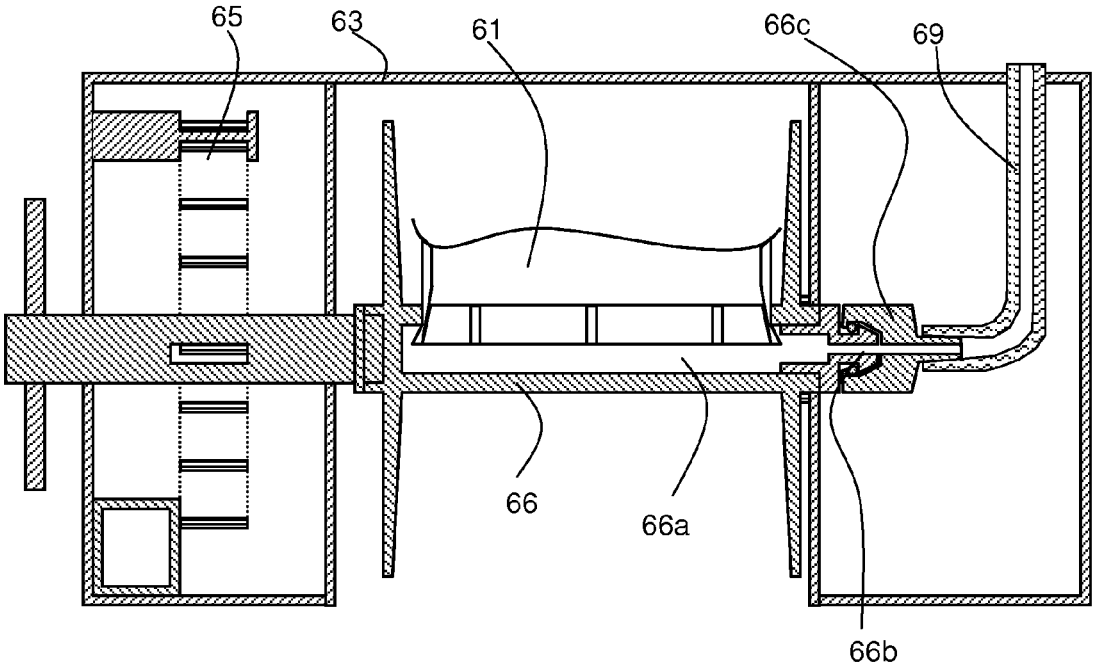
FIG. 16 is a front sectional view of an alternative configuration of the fender shown in FIG. 15.

FIG. 16 shows an alternative arrangement to that shown in FIG. 15, in which the flexible member forming the fender is mounted on the reel 66 in such a manner that it extends into and is sealingly connected with a hollow space 66*a* in the reel, which in turn communicates with an inlet nozzle 66*b* to one side of the reel. A rotary connector 66*c* is a snap seal fit on to the nozzle 66*b*, and is in turn connected to a compressed air supply hose 69 which leads to a compressed air source (not shown).

Figure 18:
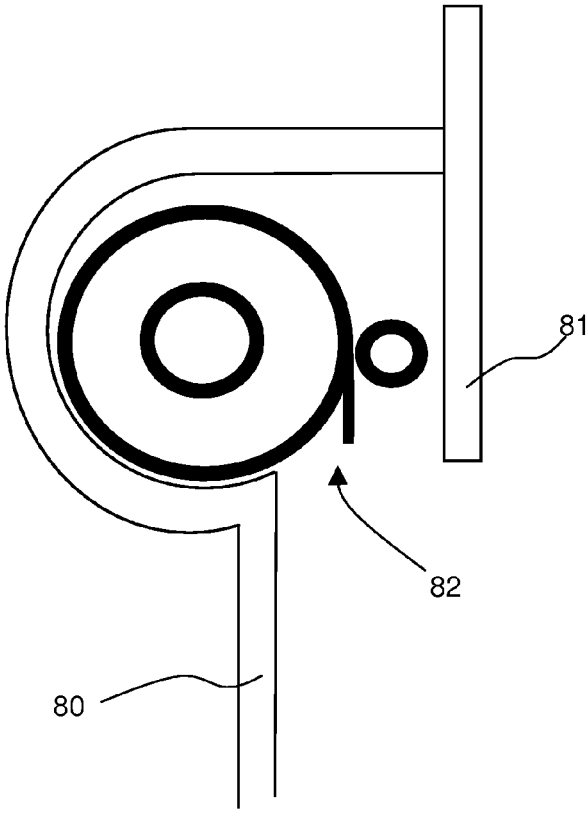
FIG. 18 is a view similar to that of FIG. 17, but showing an alternative installation for the fender of FIG. 14.
Figure 17:
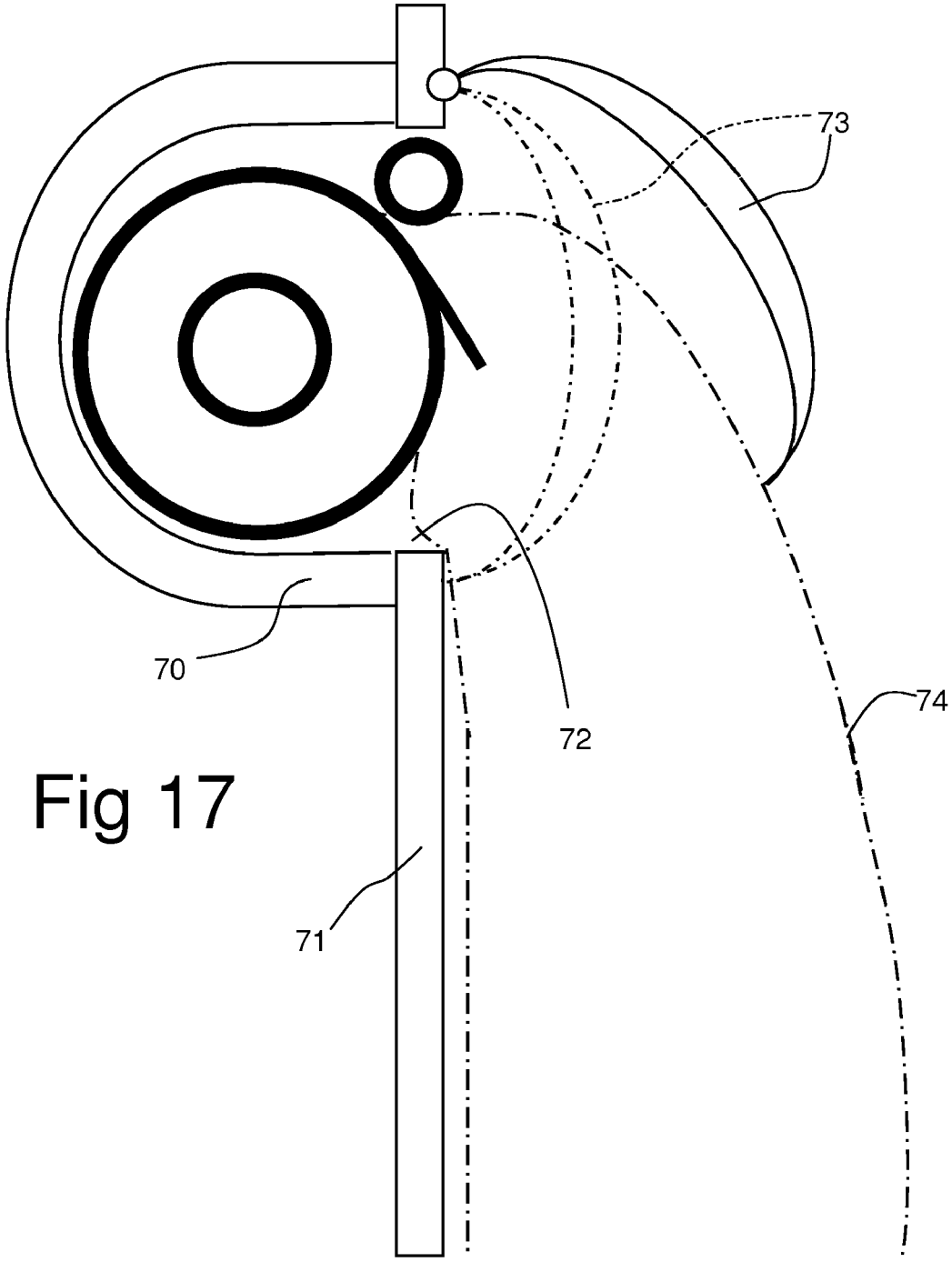
FIG. 17 is a side elevation of a portion of a boat hull having mounted therein an inflatable fender of the general type shown in FIG. 14.

FIGS. 17 and 18 show alternative configurations of the fender shown in FIG. 14. In the embodiment illustrated in FIG. 17, the fender is fitted in a housing 70 located within the boat hull 71 and communicating with the outside of the hull through an opening 72 therein. A spring-loaded hinged cover 73 locates over the opening to close it when the fender is not in use, the cover being displaced when the fender is inflated. The chain-dotted line 74 indicates the inflated state of the fender. The embodiment shown in FIG. 18 is intended to be incorporated into the hull of a boat during construction. The hull 80 is formed with an overhang 81 concealing a recess in which the fender is located. The fender then deploys downwardly through the slot 82 defined between the overhang and the side of the hull.

The invention claimed is:

1. An inflatable fender for a boat, comprising an enclosure mounted on or in the boat hull and connectible to a fluid supply, an inflatable flexible member in the form of a flat tube rolled around a first roller mounted within the enclosure and the fluid supply being connectable to the tube to inflate the tube, the tube extending from the enclosure when inflated, and drive means being provided to rotate the roller to retract the tube when not required, the fluid supply being arranged to allow the fluid to withdraw from the tube as the tube is rolled on to the roller wherein the enclosure incorporates a secondary roller provided adjacent to the first roller to press on to the tube rolled therearound, such that, on inflation, the tube extends from between the first roller and the secondary roller and causes the tube to unroll from the roller.

2. An inflatable fender according to claim 1, wherein the drive means comprises a spring drive which is tensioned by the unrolling of a resilient member connected between the free end of the inflatable member and the enclosure and arranged to extend when the inflatable member is inflated and to retract the inflatable member into the enclosure when said member is deflated.

3. An inflatable fender according to claim 1, wherein the enclosure is provided with a hinged cover which is opened by inflation and extension of the flexible member.

4. An inflatable fender according to claim 3, wherein the hinged cover is provided with a spring biasing the cover towards the closed position thereof.

5. An inflatable fender according to claim 1, wherein the enclosure is located under an overhang of the deck of the boat so as to be deployable downwardly between the overhang and the hull of the boat.

6. An inflatable fender according to claim 1, wherein the fluid is compressed air.

* * * * *